US005668093A

United States Patent [19]

Kremer et al.

[11] Patent Number: 5,668,093

[45] Date of Patent: Sep. 16, 1997

[54] USE OF ALKENYLSUCCINIC ACID HALF-AMIDES

[75] Inventors: Gernot Kremer, Kelkheim; Horst Lorke, Liederbach, both of Germany

[73] Assignee: Hoechst Aktiengesellschaft, Frankfurt am Main, Germany

[21] Appl. No.: 647,871

[22] Filed: May 3, 1996

Related U.S. Application Data

[63] Continuation-in-part of Ser. No. 470,252, Jun. 6, 1995, abandoned, which is a continuation of Ser. No. 237,329, May 3, 1994, abandoned, which is a continuation of Ser. No. 839,940, Feb. 21, 1992, abandoned.

[30] Foreign Application Priority Data

Feb. 26, 1991 [DE] Germany ..... 41 05 899.2

[51] Int. Cl.[6] ..... C10M 129/26

[52] U.S. Cl. ..... 508/262; 508/514; 72/42

[58] Field of Search ..... 508/262, 514; 72/42

[56] References Cited

FOREIGN PATENT DOCUMENTS 0074199 3/1983 European Pat. Off. .
0032383 2/1982 Japan .

*Primary Examiner*—Jacqueline V. Howard
*Attorney, Agent, or Firm*—Connolly & Hutz

[57] ABSTRACT

Alkenylsuccinic acid half-amides of the formulae

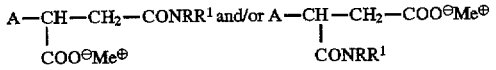

are used in water-containing and/or oil-containing formulations or metalworking liquids as anticorrosive agents and emulsifiers. In said formulae: $A=C_6-C_{30}$ alkenyl, R=H or $R^1$, $R^1=-R_2-O-(CH_2CHR^3-O)_nH$, $R^2=C_1-C_1-C_{10}$ alkylene, $R^3=-H$ or $-CH_3$, n=0 to 50 and $Me^{\oplus}$ is an alkali metal ion, a proton or an ammonium ion of the formula $HN^{\oplus}R^4R^5R^6$, $R^4$, $R^5$ and $R^6$, which are identical or different, being hydrogen, $C_1-C_6$ alkyl or hydroxyalkyl or $Me^{\oplus}$ is a mixture of an alkali metal ion and an ammonium ion of the above-mentioned formula.

20 Claims, No Drawings

USE OF ALKENYLSUCCINIC ACID HALF-AMIDES

CROSS-REFERENCE TO RELATED APPLICATIONS

This application is a continuation-in-part of application Ser. No. 08/470,252, filed on Jun. 6, 1995, and now abandoned, which in turn is a continuation of application Ser. No. 08/237,329, filed on May 3, 1994, and now abandoned, which in turn is a continuation of application Ser. No. 07/839,940 filed on Feb. 21, 1992, and now abandoned.

The application of metalworking aids extends to numerous working processes in the pretreatment and aftertreament of metals. The working spere includes the cutting and non-cutting deformation of metal parts. Drilling and cutting oils are used in the cutting deformation of metals and rolling drawing oils are used in non-cutting deformation.

Anticorrosive agents and emulsifiers in emulsifiable metalworking liquids should satisfy the following requirements:

distinct anticorrosive properties towards ferrous metals, emulsifying power towards mineral oils, if appropriate also in combination with selected non-ionic compounds, low foaming tendency or rapid foam collapse, prevention of the growth of microorganisms.

These requirements are only partially satisfied by the compounds listed in European patent document A-0127132. Said document has already disclosed alkenylsuccinic acid half-amides of the formula $$R-\underset{\underset{COO^{\ominus}K^{\oplus}}{|}}{CH}-CH_2-CONH_2$$

R being $C_6$–$C_{12}$ alkenyl, and their use as anticorrosive agents. However, these compounds have an inadequate emulsifying power resulting in unsatisfactory pot lives of the working emulsions. Moreover, emulsions containing these compounds tend to foam, which is particularly disadvantageous in the case of working processes such as grinding, when the emulsions are exposed to substantial mechanical influences.

These disadvantages can be overcome by the alkenylsuccinic acid half-amides according to the invention, which are usually obtained by reacting alkenylsuccinic anhydrides with alkanolamines. The opalescence of the emulsions which is achieved with these alkenylsuccinic acid half-amides indicates a finer distribution than that of emulsions containing the known products of European patent document A-0127132, and hence long pot lives, i.e. a long useful life of the emulsion. The requirement of low foaming tendency or rapid foam collapse is also satisfied better by the alkenylsuccinic acid half-amides according to the invention.

The invention therefore relates to the use of alkenylsuccinic acid half-amides of the formulae $$A-\underset{\underset{COO^{\ominus}Me^{\oplus}}{|}}{CH}-CH_2-CONRR^1 \text{ and/or } A-\underset{\underset{CONRR^1}{|}}{CH}-CH_2-COO^{\ominus}Me^{\oplus}$$

if appropriate mixed with cyclic imides of the formula

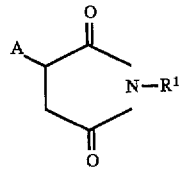

as metalworking aids, especially as anticorrosive agents and emulsifiers in aqueous and/or oil-containing formulations or in dilute form in metalworking liquids.

The two half-amides are generally present as a mixture. In said formulae:

A is $C_6$–$C_{30}$ alkenyl, especially $C_{10}$–$C_{24}$ alkenyl, it being possible for A to be linear or branched;

R=H or $R^1$; when $R=R^1$, the two radicals R and $R^1$ are identical or different;

$R^1$ is $—R^2—O—(CH_2CHR^3—O)_nH$, where $R^2=C_1$–$C_{10}$ alkylene especially $C_1$–$C_5$ alkylene, it being possible for $R^2$ to be linear or branched, $R^3$=—H or —$CH_3$ and n=0 to 50, preferably 0–10 and especially 0–5; and $Me^{\oplus}$ is an alkali metal ion, especially $Na^+$, $K^+$, a proton and/or an ammonium ion of the formula $HN^{\oplus}R^4R^5R^6$, $R^4$, $R^5$, and $R^6$, which are identical or different, being hydrogen, $C_1$–$C_6$ alkyl or hydroxy($C_1$–$C_6$)alkyl, especially 2-hydroxyethyl or 2-hydroxypropyl or $Me^{\oplus}$ is a mixture of the above-identified alkali metal ion and ammonium ion.

Said imides occur as by-products in the preparation of the compounds according to the invention and are usually present in the mixture in a concentration of 0–30% by weight.

The invention further relates to water-containing and/or oil-containing formulations and metalworking liquids in which these compounds are present as anticorrosive agents and emulsifiers.

The preparation of the alkenylsuccinic anhydrides, used as starting materials, from an olefin and maleic anhydride is known. Preferred olefins are oligomers of ethylene, propylene and butylene and olefins with an internal double bond. The alkenylsuccinic acid half-amides according to the invention are obtained by reacting 1 mol of an alkenylsuccinic anhydride with 0.7 to 2.5, preferably 0.8 to 1.2 mol of alkanolamine at 0° to 60° C. If the proportion of cyclic imide is to be increased, a higher reaction temperature is found to be expedient. Neutralization of the resulting alkenylsuccinic acid half-amides with amines and/or alkali metal hydroxides gives the corresponding ammonium and/or alkali metal salts of the alkenylsuccinic acid half-amides.

According to the invention, it is particularly preferable to use the alkanolamine salts in which $Me\oplus$ is $NHR^4R^5R^6$ where $R^4=R^5=R^6$ and are hydroxy($C_1$–$C_4$)alkyl. These alkanolamine salts are prepared by reacting the initially obtained alkenylsuccinic acid half-amides with the appropriate alkanolamine.

The alkenylsuccinic acid half-amides of the invention form clear solutions in water and, with mineral oil, give formulations which are readily emulsifiable in water. These compounds are used in concentrated form as emulsifiers and anticorrosive agents in oil-containing and/or aqueous formulations. The concentration of the half-amides in the formulation is greater than during use and is usually 20–80% by weight. For cutting or non-cutting deformation, e.g. in drilling, cutting, drawing and rolling liquids, the formulation is diluted with water.

To prepare the formulations, the products according to the invention are either stirred into the requisite amount of water or mixed with mineral oil or mineral oil/water. The resulting aqueous or oil-containing formulations are diluted or emulsified with water by the user. The dilution ratio is generally 1:10 to 1:100. The use concentration of the half-amides in metalworking liquids, e.g. drilling, cutting, drawing and rolling liquids, is generally about 0.1 to 10% by weight, preferably 2–10% by weight. Said concentrations are based on the use of the products in water as well as in mineral oil/water emulsions in the case of metalworking. Metalworking liquids are also to be understood as meaning cooling lubricants.

The alkenylsuccinic acid half-amides are used as anticorrosive emulsifiers in aqueous metalworking liquids containing mineral oil and as anticorrosive agents in aqueous metalworking liquids not containing mineral oil. They are suitable for mixing with all conventional mineral oils, especially with mineral oils having a naphthene base, paraffin base or mixed base.

The formulations or metalworking liquids can contain additional-auxiliaries for optimizing the emulsifying behavior and anticorrosive action. For this purpose, it is particularly advantageous to use ethoxylates of the general formula $$R^7—O—(CH_2—CH_2—O)_nH,$$

$R^7$ being $C_{10}$–$C_{22}$ alkyl, $C_{10}$–$C_{22}$alkenyl or alkylphenyl having a total of 10 to 20 carbon atoms and n being a number from 2 to 10. Fatty acid alkanolamides of the general formula $$R^8—CO—NR^9R^{10},$$

$R^8$ being $C_{10}$–$C_{22}$ alkyl or $C_{10}$–$C_{22}$ alkenyl and $R^9$ and $R^{10}$, which are identical or different, being hydrogen or hydroxy ($C_{-C6}$)alkyl, especially 2-hydroxyethyl or 2-hydroxypropyl, are also used as auxiliaries. Further suitable auxiliaries are fatty acid polyglycol esters, especially those of saturated or unsaturated fatty acids having 10 to 22 carbon atoms in the alkyl chain and those having 1 to 10 ethylene oxide units, e.g. oleic acid having 4 to 6 ethylene oxide units. These auxiliaries are generally present in the formulations in amounts of approx. 20 to 40% in each case, either on their own or as a mixture.

Additives conventionally used for these purposes, e.g. antifoams, can also be present in the formulations.

The invention is illustrated in greater detail by means of the following Examples.

EXAMPLE 1

Preparation of the triethanolamine/sodium salt of tripropenylsuccinic acid hydroxyethyl half-amide.

61 g (1.0 mol) of monoethanolamine and 90 g of deionized water are placed in a 3-necked flask equipped with dropping funnel, thermometer and stirrer. 1.0 mol of tripropenylsuccinic anhydride is then added dropwise over 30 minutes, the temperature being kept at max. 30° C. by cooling. When the dropwise addition is complete, the mixture is stirred for a further 3 hours at 30° C.

149 g (1.0 mol) of triethanolamine are then added to this solution at 30° C., the mixture is stirred for 5 minutes and 48 g (0.6 mol) of NaOH (50% aqueous solution) are then added. The solution is subsequently homogenized at 60° C. for 1 hour to give 572 g of a brown viscous oil. The triethanolamine may also be added during the reaction of the monoethanolamine with the tripropenylsuccinic anhydride.

EXAMPLE 2

Preparation of the triethanolamine/sodium salt of n-$C_{12}$/n-$C_{14}$ alkenylsuccinic acid hydroxyethyl half-amide.

The preparation is carried out analogously to Example 1. 1.0 mol of $C_{12}$/$C_{14}$ alkenylsuccinic anhydride are added dropwise.

623.8 g of a brown viscous oil are obtained.

EXAMPLE 3

Preparation of the triethanolamine/sodium salt of pentapropenylsuccinic acid hydroxyethyl half-amide, The preparation is carried out analogously to Example 1. 348 g (1.0 mol) of pentapropenylsuccinic anhydride are added dropwise to 48.8 g (0.8 mol) of monoethanolamine.

683.8 g of a brown viscous oil are obtained.

The anhydride content of the technical-grade pentapropenylsuccinic anhydride is approx. 68%.

EXAMPLE 4

Preparation of the triethanolamine/sodium salt of pentapropenylsuccinic acid hydroxyisopropyl half-amide.

60 g (0.8 mol) of monoisopropanolamine and 90 g of deionized water are placed in a 3-necked flask equipped with dropping funnel, thermometer and stirrer. 348 g (1.0 mol) of pentapropenylsuccinic anhydride are then added dropwise over 30 minutes, the temperature being kept at max. 30° C. by cooling. When the dropwise addition is complete, the mixture is stirred for a further 3 hours at 30° C.

149 g (1.0 mol) of triethanolamine are then added to this solution at 30° C., the mixture is stirred for 5 minutes and 48 g (0.6 mol) of NaOH (50% aqueous solution) are then added. The solution is subsequently homogenized at 60° C. for 1 hour.

695 g of a brown viscous oil are obtained.

EXAMPLE 5

Preparation of the triethanolamine/sodium salt of pentapropenylsuccinic acid diglycol half-amide.

84 g (0.8 mol) of diglycolamine and 90 g of deionized water are placed in a 3-necked flask equipped with dropping funnel, thermometer and stirrer. 348 g (1.0 mol) of pentapropenylsuccinic anhydride are then added dropwise over 30 minutes, the temperature being kept at max. 30° C. by cooling. When the dropwise addition is complete, the mixture is stirred for a further 3 hours at 30° C. 149 g (1.0 mol) of triethanolamine are then added to this solution at 30° C., the mixture is stirred for 5 minutes and 48 g (0.6 mol) of NaOH (50% aqueous solution) are then added. The solution is subsequently homogenized at 60° C. for 1 hour.

719 g of a brown viscous oil are obtained.

EXAMPLE 6

Preparation of the triethanolamine/sodium salt of n-$C_{10}$/n-$C_{14}$ alkenylsuccinic acid hydroxyethyl half-amide.

The preparation is carried out analogously to Example 1. 263 g (1.0 mol) of $C_{10}$/$C_{14}$ alkenylsuccinic anhydride are added dropwise.

611 g of a brown viscous oil are obtained.

EXAMPLE 7

Preparation of the triethanolamine/sodium salt of pentapropenylsuccinic acid bis(hydroxyethyl) half-amide.

0.8 mol of diethanolamine and 90 g of deionized water are placed in a 3-necked flask equipped with dropping funnel, thermometer and stirrer. 348 g (1.0 mol) of pentapropenylsuccinic anhydride are then added dropwise over 30 minutes, the temperature being kept at max. 30° C. by cooling. When the dropwise addition is complete, the mixture is stirred for a further 3 hours at 30° C.

1.0 mol of triethanolamine is added to this solution at 30° C., the mixture is stirred for 5 minutes and 0.6 mol of NaOH (50% aqueous solution) is then added. The solution is subsequently homogenized at 60° C. for 1 hour.

719 g of a brown viscous oil are obtained.

EXAMPLE 8

Emulsifier mixture.

370 g of the substance of Example 1, 310 g of tall oil fatty acid diethanolamide and 320 g of oleyl alcohol polyglycol ether (2 mol of ethylene oxide)

are mixed at room temperature and stirred until a clear solution is formed.

EXAMPLE 9 to 14

Emulsifier mixtures.

370 g of each of the substances of Examples 2 to 7 are mixed analogously to Example 8 with the two compounds indicated therein.

The advantageous properties of the compounds or mixtures prepared in the Examples can be seen from the measurement values listed in the following Tables.

| Example | 1 | 2 | 3 | 4 | 5 | 6 | 7 |
|---|---|---|---|---|---|---|---|
| Appearance/20° C. | | | | clear brown liquid | | | |
| pH | | | | | | | |
| 1% in dist. water | 8,3 | 8,4 | 8,7 | 9,0 | 9,0 | 8,5 | 9,1 |
| Solubility | | | | | | | |
| 3% solution in $H_2O$ | | | | | | | |
| 0° dH, immediately | transp. | transp. | clear | turbid | turbid | clear | turbid |
| 0° dH, after 24 hours | transp. | transp. | clear | turbid | turbid | clear | turbid |
| 20° dH (natural water), immediately | turbid | transp. | transp. | turbid | turbid | clear | turbid |
| 20° dH (natural water), after 24 hours | turbid | turbid | transp. | turbid | turbid | clear | turbid |
| 20° dH (synthetic water/ DIN 51360/1), immediately | turbid | turbid | transp. | turbid | turbid | clear | turbid |
| 20° dH (synthetic water/ DIN 51360/1), after 24 hours | turbid | turbid | transp. | turbid | turbid | clear | turbid |
| Foaming behavior* | | | | | | | |
| 3% solution in $H_2O$ | | | | | | | |
| dist. $H_2O$, immediately | copious foam | copious foam | foam | copious foam | copious foam | copious foam | copious foam |
| after 5 minutes | foam | foam | collapsed | foam | foam | foam | foam |
| 20° dH (natural water), | | | | | | | |
| immediately | foam | foam | meager foam | foam | foam | foam | foam |
| after 5 minutes | foam | foam | collapsed | foam | foam | foam | foam |
| 20° dH (synthetic water), | | | | | | | |
| immediately | foam | foam | meager foam | foam | foam | foam | foam |
| after 5 minutes | foam | foam | collapsed | foam | foam | foam | foam |
| Anticorrosive action | | | | | | | |
| DIN 51360/1 dist. $H_2O$ 1% | no rust | trace of rust | no rust | no rust | no rust | no rust | no rust |
| 20° dH (natural water), 2,5% | trace of rust | trace of rust | no rust | no rust | meager rust | no rust | meager rust |
| 20° dH (synthetic water), 3% | trace of rust | trace of rust | no rust | meager rust | rust | trace of rust | meager rust |
| DIN 51360/2 dest. $H_2O$, 1,5% | no rust | no rust | no rust | rust | rust | no rust | rust |
| 20° dH (natural water), 2,5% | no rust | no rust | no rust | trace of rust | rust | no rust | meager rust |
| 20° dH (synthetic water), | trace of rust | trace of rust | no rust | no rust | trace of rust | no rust | no rust |

| Example | 8 | 9 | 10 | 11 | 12 | 13 | 14 |
|---|---|---|---|---|---|---|---|
| 5% emulsion composed of 80% of mineral oil 20% of emulsifier | | | | | | | |
| a) Emulsifying behavior | | | | | | | |
| dist. $H_2O$, immediately | milky | milky | milky-opal. | milky-opal. | milky-opal. | milky-opal. | milky-opal. |
| after 24 hours | creamy | creamy | unchanged | unchanged | unchanged | unchanged | unchanged |

-continued

| | | | | | | | |
|---|---|---|---|---|---|---|---|
| 20° dH (natural water), | | | | | | | |
| immediately | milky | milky | milky-opal. | milky-opal. | milky-opal. | milky-opal. | milky-opal. |
| after 24 hours | creamy | very creamy | unchanged | unchanged | unchanged | unchanged | unchanged |
| 20° dH (synthetic water), | | | | | | | |
| immediately | milky | milky | milky-opal. | milky-opal. | milky-opal. | milky-opal. | milky-opal. |
| after 24 hours | creamy | creamy/oil | unchanged | unchanged | unchanged | unchanged | unchanged |
| b) Anticorrosive action | | | | | | | |
| DIN 51360/ 1:2% emulsion dist. $H_2O$ | no rust | no rust | no rust | no rust | no rust | no rust | no rust |
| 20° dH (synthetic $H_2O$) | rust | rust | no rust | meager rust | meager rust | meager rust | meager rust |
| c) Foaming behavior | | | | | | | |
| 20° dH (natural water), | | | | | | | |
| immediately | foam | foam | trace of foam | foam | foam | foam | foam |
| after 5 minutes | foam | foam | no foam | foam | foam | foam | foam |
| pH-Wert | | | | | | | |
| 1% in dist. water | 8,8 | 9,0 | 9,1 | 9,0 | 9,0 | 8,8 | 9,1 |

*50 ml are shaken vigorously for 1 min in a stoppered 250 ml measuring cylinder

What is claimed is:

1. Metalworking aids comprising alkenysuccinic acid half-amides of at least one formula selected from the group consisting of

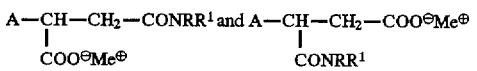

and, optionally, cyclic imides of the formula

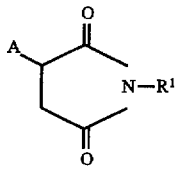

in which formulae:

A is $C_6$–$C_{30}$ alkenyl and is linear or branched,

R=H or $R^1$, $R^1$=—$R^2$—O—($CH_2CHR^3$—O)$_n$H, where $R^2$=$C_1$–$C_{10}$ alkylene, $R^2$ being linear or branched, $R^3$=—H or $CH_3$ and n=0 to 50 and $Me^{\oplus}$ is a mixture of an alkali metal ion and an ammonium ion of the formula $HN^{\oplus}R^4R^5R^6$, $R^4$, $R^5$ and $R^6$, which are identical or different, being hydrogen, $C_1$–$C_6$ alkyl or hydroxy ($C_1$–$C_6$) alkyl.

2. A formulation comprising the metalworking aids of claim 1 and at least one of water and mineral oil, said formulation additionally containing at least one auxiliary selected from the group consisting of i) ethoxylates of the general formula $$R^7—O—(CH_2—CH_2—O)_nH$$

$R^7$being $C_{10}$–$C_{22}$ alkyl, $C_{10}$–$C_{22}$ alkenyl or alkylphenyl having a total of 10 to 20 carbon atoms and n being a number from 2 to 10; (ii) fatty acid alkanolamides of the general formula $$R^8—CO—NR^9R^{10}$$

$R^8$ being $C_{10}$–$C_{22}$alkyl or $C_{10}$–$C_{22}$alkenyl and $R^9$ and $R^{10}$, which are identical or different, being hydrogen or hydroxy ($C_1$–$C_6$)alkyl; and (iii) fatty acid polyglycol esters.

3. A method of using the formulation of claim 2, wherein said method comprises diluting said formulation with water to form a liquid and using said liquid for metalworking.

4. A metalworking liquid containing at least one of water and oil, said metalworking liquid further containing an alkenylsuccinic acid half-amide as claimed in claim 1.

5. A formulation comprising the metalworking aids of claim 1 and at least one of water and oil.

6. The formulation of claim 2, wherein said formulation comprises about 20–80% by weight of said alkenylsuccinic acid half-amides.

7. The method of claim 3, wherein said liquid comprises about 0.1 to 10% by weight of said alkenylsuccinic acid half-amides.

8. A formulation according to claim 2, wherein said formulation comprises water and at least one mineral oil, said alkenylsuccinic acid half-amides acting as anticorrosive emulsifiers in said formulation.

9. A formulation according to claim 2, wherein said formulation does not contain oil and said alkenylsuccinic acid half-amides are used as anticorrosive agents.

10. Metalworking aids according to claim 1, wherein A is $C_{10}$–$C_{24}$ alkenyl and is linear or branched.

11. Metalworking aids according to claim 1, wherein $R^2$ is $C_1$–$C_5$ alkylene and is linear or branched.

12. Metalworking aids according to claim 1, wherein n=0 to 10.

13. The formulation of claim 2, wherein said at least one auxiliary is present in an amount of about 20 to 40% by weight.

14. A metalworking liquid comprising the formulation of claim 2, wherein the liquid further comprises additional water so that the dilution ratio of the formulation to the additional water is from about 1:10 to 1:100.

15. The formulation of claim 2, wherein said hydroxy ($C_1$–$C_6$) alkyl is 2-hydroxyethyl or 2-hydroxypropyl.

16. The method of claim 3, wherein said formulation is used as a cooling lubricant in metalworking.

17. The formulation of claim 2, wherein said cyclic imides are present in said formulation in an amount of from about 0–30% by weight.

18. The method of claim 3, wherein the ratio of said formulation to the water that is used to dilute the formulation is from about 1:10 to 1:100.

19. Metalworking aids according to claim 1, wherein $Me^{\oplus}$ is a mixture of an alkali metal ion and an ammonium ion of the formula $HN^{\oplus}R^4R^5R^6$, wherein $R^4$, $R^5$ and $R^6$, are identical or different and are hydroxy ($C_1$–$C_6$) alkyl.

20. Metalworking aids according to claim 1, wherein $Me^{\oplus}$ is a mixture of an alkali metal ion selected from the group consisting of sodium and potassium and an ammonium ion of the formula $HN^{\oplus}R^4R^5R^6$, $R^4$, $R^5$ and $R^6$, which are identical or different, being hydrogen, $C_1$–$C_6$ alkyl or hydroxy ($C_1$–$C_6$) alkyl.

* * * * *